United States Patent [19]

Watanabe et al.

[11] 4,272,460

[45] Jun. 9, 1981

[54] VARIABLE VENTURI TYPE CARBURETOR

[75] Inventors: Noboru Watanabe, Susono; Tokuta Inoue, Mishima; Kiyohiko Oishi, Susono, all of Japan

[73] Assignee: Toyota Jidosha Kogyo Kabushiki Kaisha, Toyota, Japan

[21] Appl. No.: 125,633

[22] Filed: Feb. 28, 1980

[30] Foreign Application Priority Data

Mar. 7, 1979 [JP] Japan ..... 54/25617

[51] Int. Cl.[3] ..... F02M 9/02

[52] U.S. Cl. ..... 261/53; 123/472; 123/489; 261/44 C; 261/DIG. 82

[58] Field of Search ..... 261/44 C, DIG. 74, 53, 261/62, DIG. 82; 123/489, 472, 470, 478, 439

[56] References Cited

U.S. PATENT DOCUMENTS

| | | | |
|---|---|---|---|
| 3,782,639 | 1/1974 | Bultz et al. | 123/472 |
| 3,855,974 | 12/1974 | Mayer | 261/DIG. 74 |
| 4,132,203 | 1/1979 | Elpern et al. | 123/472 |

FOREIGN PATENT DOCUMENTS

| | | | |
|---|---|---|---|
| 43372 | 12/1973 | Austria | 261/44 C |
| 54-105620 | 8/1979 | Japan | 261/53 |

*Primary Examiner*—Tim R. Miles

*Attorney, Agent, or Firm*—Stevens, Davis, Miller & Mosher

[57] ABSTRACT

A variable venturi type carburetor of an internal combustion engine which includes a housing, a bore extending through the housing and having an inner wall defining an intake passage, a suction piston movably mounted in the housing and having a head portion projecting into the intake passage and a fuel injection valve. The suction piston moves so as to change the cross-sectional area of the venturi portion defined between the head portion of the suction piston and an inner wall of the intake passage. A pipe member connected to the fuel injection valve is opened to the intake passage in a position opposite the head portion with regard to the intake passage. The fuel injected from the injection valve is supplied through the pipe member to the intake passage.

5 Claims, 6 Drawing Figures

VARIABLE VENTURI TYPE CARBURETOR

BACKGROUND OF THE INVENTION

This invention relates to a carburetor of an internal combustion engine, and more particularly relates to a variable venturi type carburetor having an electronic control fuel injection valve.

A variable venturi type carburetor having a fuel injection valve comprises a suction piston movably mounted on a venturi portion of an intake passage, so as to vary the cross-sectional area of the venturi in accordance with the change in the amount of air being fed to the engine combustion chambers. As is well-known, the cross-sectional area of the venturi portion is controlled so that the velocity of air flowing in the venturi, that is, the vacuum level in the venturi, is always maintained at a constant value. Fuel is injected into the venturi portion from the fuel injection valve provided in the vicinity of the venturi portion, and atomized so as to be mixed with sucked air. The fuel injection valve is usually controlled electronically in accordance with the running conditions of the engine, such as, the amount of sucked air, the rate of engine revolution speed, the temperature of sucked air, the temperature of engine cooling water and so on; and/or in accordance with the running conditions of the engine measured by the signals from an $O_2$ sensor provided in an exhaust passage, so that the necessary amount of fuel is supplied wherein the actual air fuel-ratio of the mixture is in the vicinity of the so called stoichiometric air fuel-ratio.

However, in a variable venturi type carburetor having an electronic control fuel injection valve, because the fuel injection valve is actuated and electronically controlled with the signal pulse and the pulse interval and/or the amount of fuel injection in each pulse is electronically controlled in accordance with the running conditions of the engine, fuel injection takes place periodically. In a conventional variable venturi carburetor of this type, therefore, the fuel, the particles of which are relatively large, is injected from the fuel injection valve into the venturi portion. The fuel particles then beat against a throttle valve provided at the downstream area of the venturi portion and pass through a gap between the throttle valve and an inner bore wall of the carburetor. When these particles pass through the gap, the fuel is a rich mixture which is supplied into engine combustion chambers. Subsequently, until the next fuel particles are injected and supplied through said gap, the fuel is a lean mixture which is supplied into the engine combustion chambers. Such an alternate fuel supply of the rich and lean mixtures results in, especially during the low-speed running operation of the engine, the change of engine torque, the instability of idling operation and/or surging.

When the diameter of the fuel particles is so large that the fuel is not fully mixed with sucked air and comes into collision with the throttle valve and if the position of the collision is away from the center portion of the throttle valve, there appear areas of both lean and rich mixtures. Therefore, only the rich mixture is supplied into a certain cylinder or cylinders of the multi-cylinder engine. As a result, an effective engine output power cannot be obtained.

SUMMARY OF THE INVENTION

An object of this invention is to provide a variable venturi type carburetor of an internal combustion engine capable of overcoming the defects mentioned above.

Another object of this invention is to provide a variable venturi type carburetor of an internal combustion engine in which the fuel injected from an electronic control fuel injection valve consists of atomized fine fuel particles so that, especially when the engine is operating in a little suction air condition, the stability of the engine revolutions is improved.

A further object of this invention is to provide a variable venturi type carburetor of an internal combustion engine capable of uniformly spreading the fine fuel particles injected from a fuel injection valve on the upper surface of a throttle valve so as to be homogeneously mixed with air, thereby improving the combustion characteristic of the engine, reducing the rate of fuel consumption and reducing noxious combustible substances, such as hydrocarbons (HC) and carbon monoxide (CO), in the exhaust gas.

According to the present invention, there is provided a variable venturi type carburetor, comprising: a housing; a bore extending through said housing and having an inner wall defining an intake passage; a suction piston movably mounted in said housing and having a head portion projecting into said intake passage, said head portion of the suction piston and said inner wall of the intake passage defining a venturi, said suction piston moving so as to change the cross-sectional area of said venturi in response to a change in the vacuum produced in said intake passage downstream of said venturi at a constant value; an electronic control fuel injection valve being controlled so as to inject the necessary amount of fuel into said intake passage in response to the engine running conditions, and; a pipe member being opened at the free end thereof to said intake passage in a position opposite to said head portion of the suction piston with regard to said intake passage and connected at the other end thereof to a nozzle end portion of said fuel injection valve so that the fuel injected from the fuel injection valve is supplied through said pipe member into the intake passage.

It is advantageous that said pipe member is so arranged that the central axis thereof is perpendicular to the air flow passing through the venturi portion and is substantially the same as the central axis of the suction piston.

According to an embodiment of the present invention, the free end of the pipe member is formed by cutting with an inclined oval cross-section and said pipe member is so arranged that the distance from the pipe cut edge at the downstream side of the venturi to said head portion of the suction piston is smaller than the distance from the pipe cut edge at the upstream side of the venturi to the same head portion.

According to another embodiment of the present invention, said pipe member is formed at the free end thereof with a flat portion which defines an elongated slit extending in the direction perpendicular to the air flowing in the venturi portion and perpendicular to the direction to which the suction piston moves.

According to still another embodiment of the present invention, said pipe member is formed at the free end thereof with a widened shaped portion as a shape of trumpet.

BRIEF DESCRIPTION OF THE DRAWINGS

The present invention may be more fully understood from the description set forth below of preferred embodiments of the present invention, together with the accompanying drawings, wherein.

DESCRIPTION OF PREFERRED EMBODIMENTS

Figure 1:
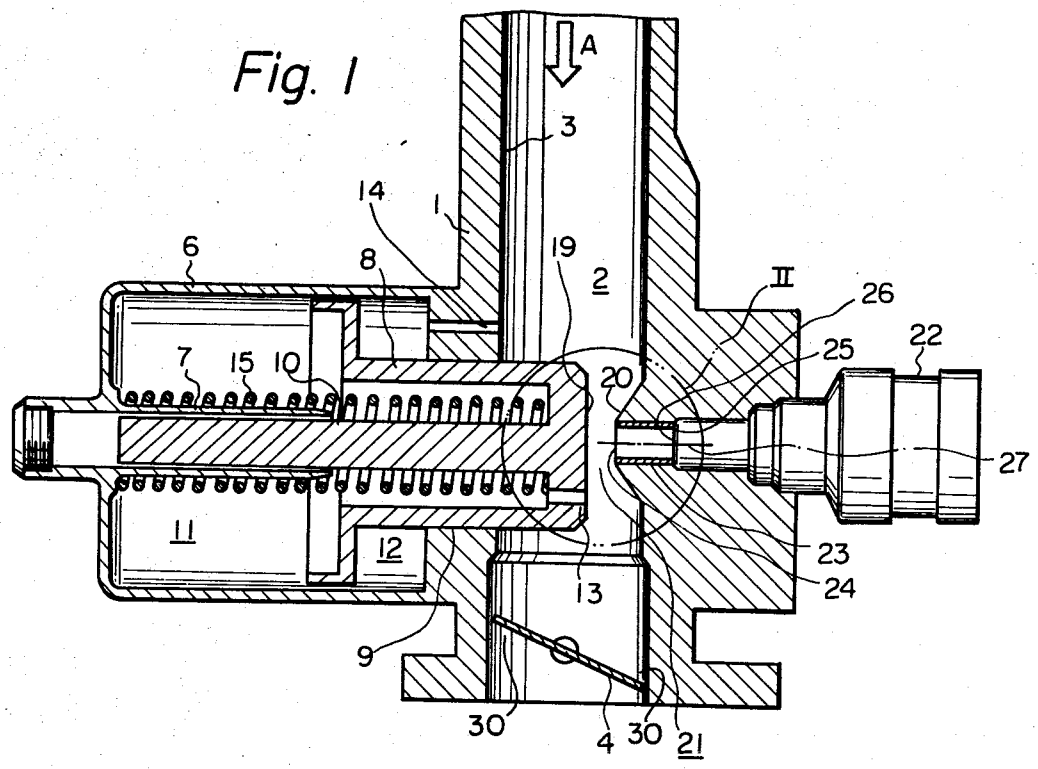
FIG. 1 is a cross-sectional view of a variable venturi type carburetor of the present invention.

Referring now to FIG. 1, a carburetor body 1 has a bore 3 which defines an intake passage 2 therein. Reference numeral 4 designates a throttle valve. The introduced air flows in the intake passage 2 in the direction shown by arrow A. Reference numeral 6 designates a housing or outer casing, which has a hollow cylindrical guide 7 extending in the central portion of the inside of the outer casing 6. Reference numeral 8 designates a suction piston which is secured and slidingly guided within a guide hole 9 formed in the carburetor body 1 and has a piston rod 10 extending in the left direction in FIG. 1. The piston rod 10 is also secured and slidingly guided within the hollow cylindrical guide 7. A vacuum chamber 11 and an atmospheric pressure chamber 12, which are separated by the suction piston 8, are formed in the outer casing 6. The vacuum chamber 11 is connected to the intake passage 2 downstream of a venturi portion 21 via a suction hole 13; thus, a vacuum is produced in the vacuum chamber 11. On the other hand, the atmospheric pressure chamber 12 is connected to the intake passage 2 upstream of the venturi portion 21 via an air hole 14; thus, the pressure in the atmospheric pressure chamber 12 is maintained at approximately atmospheric pressure. A compression spring 15 is disposed between the suction piston 8 and the outer casing 6. The suction piston 8 is always biased in the axial direction due to the spring force of the compression spring 15.

Figure 2:
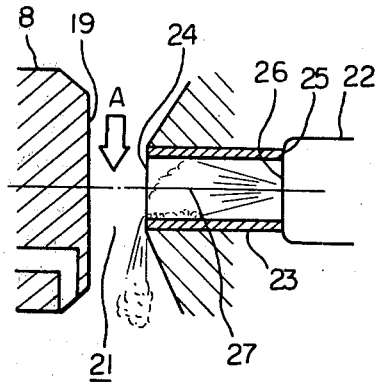
FIG. 2 is an enlarged view of the portion indicated by II in FIG. 1.

The suction piston 8 has a head portion 19 which projects from the bore wall 3 of the carburetor body 1 into the intake passage 2. Between the end face of the head portion 19 and an inner wall 20 of the bore 3 opposite the head portion a venturi portion 21 is formed, the cross-sectional area of which is variable. An electronic control fuel injection valve 22 is arranged at a position opposite the suction piston 8 in relation to the intake passage 2 of the carburetor body 1. A pipe member 23 made of suitable material is rigidly inserted into a bore 3 of the carburetor body 1. One end 24 of this pipe member 23 is opened to the intake passage 2, i.e. to the venturi portion 21, at the above-mentioned position opposite the suction piston 8, while the other end 25 of the pipe member 23 is connected to a nozzle end portion 26 of the fuel injection valve 22. According to the embodiment illustrated in FIG. 1, the pipe member 23 is so arranged that the central axis 27 thereof is perpendicular to the air flow passing through the venturi portion 21 and is substantially the same as the central axis of the suction piston 8. In addition, according to the embodiment illustrated in FIGS. 1 and 2, the free end 24 of the pipe member 23 is formed by cutting the member along a plain surface perpendicular to said central axis 27.

Figure 3:
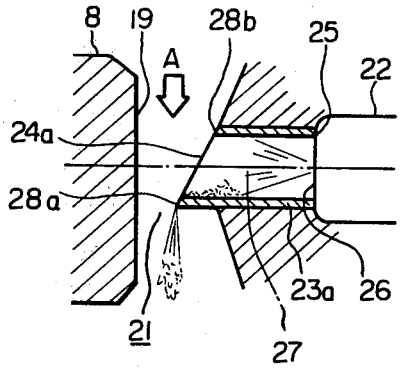
FIG. 3 is a view similar to FIG. 2 but illustrating another embodiment of the present invention.

According to an embodiment illustrated in FIG. 3, the free end 24*a* of a pipe member 23*a* is formed by cutting the member along an inclined oval cross-section. This pipe member 23*a* is so arranged that the distance from a pipe cut edge 28*a* at the downstream side of the venturi 21 to the head surface 19 of the suction piston 8 is smaller than the distance from a pipe cut edge 28*b* at the upstream side of the venturi to the same head surface 19.

Figure 4:
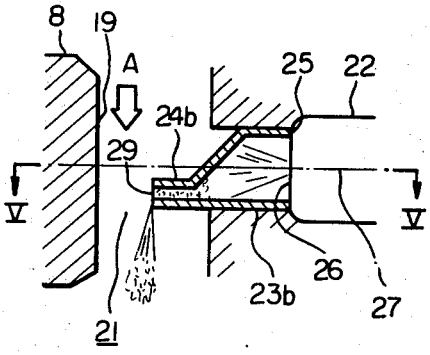
FIG. 4 is a view similar to FIG. 2 but illustrating still another embodiment of the present invention.
Figure 5:
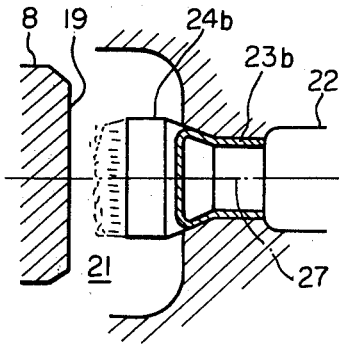
FIG. 5 is a cross-sectional view taken along line V—V in FIG. 4.

According to an embodiment illustrated in FIGS. 4 and 5, a pipe member 23*b* is formed at the free end 24*b* thereof with a flat shaped portion, which defines an elongated narrow slit 29 extending in the direction perpendicular to the air flow in the venturi portion 21 and perpendicular to the direction along which the suction piston 8 moves.

Figure 6:
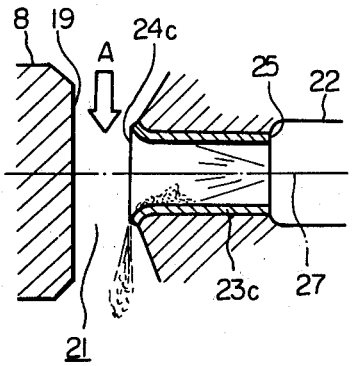
FIG. 6 is a view similar to FIG. 2 but illustrating a further embodiment of the present invention.

According to an embodiment illustrated in FIG. 6, a pipe member 23*c* is formed at the free end 24*c* thereof with a widened shaped portion as a shape of trumpet.

The operation of the variable venturi type carburetor of the present invention will now be described. In FIG. 1, as is known to those skilled in the art, the suction piston 8 moves toward the right and left due to the difference between the pressure in the atmospheric pressure chamber 12 and the vacuum in the vacuum chamber 11, and the cross-sectional area of the venturi portion 21 is varied so that the velocity of air flowing in the venturi portion 21 is maintained at a constant value. Since the velocity of air flowing in the venturi portion 21 is always maintained at a constant value without regard to the amount of air flowing in the venturi portion 21, a vacuum of a constant level, for example 100 through 200 mmAq, is always produced in the venturi portion 21.

The fuel injection valve 22 is controlled electronically in accordance with the running conditions of the engine, such as, the amount of sucked air, the engine revolution speed, the temperature of sucked air, the temperature of engine cooling water and so on, and in accordance with the running conditions of the engine as measured by the signals from an $O_2$ sensor provided in an exhaust passage. Thus, the necessary amount of fuel to be injected is determined in accordance with these engine running conditions, and the fuel injection valve 22 is actuated by certain intervals of signals so as to inject the necessary amount of fuel. Therefore, the necessary amount of fuel is periodically injected from the nozzle injection port 26 of the fuel injection valve 22 into the intake passage 2.

Fuel is injected at a certain extension (a certain injected angle) from the nozzle injection port 26 of the fuel injection valve 22. A part of the fuel collides with the inner wall of the pipe member 23 and reaches the free end of the pipe member 23 along the inner wall thereof. The fuel is there blown into fine fuel particles by the air flowing in the venturi portion 21. Then, the fine fuel particles flow with the air to the downward area of the venturi portion 21 and come into collision with the throttle valve 4. According to the present invention, the fuel injected form the injection valve 22 turns fine fuel particles, and the amount of fuel which attaches to the inner wall of the venturi portion 21, such as the head surface 19 of the suction piston 8, is small, so that the fuel which collides with the throttle valve 4 continuously flows in a state of homogeneous mixed condition through the gaps 30 (see FIG. 1) defined between the throttle valve 4 and the bore wall 3. Therefore, to the engine combustion chambers (not illustrated in the drawings) homogeneous fine fuel mixture is supplied.

In the embodiment illustrated in FIG. 3, because the free end 24*a* of the pipe member 23*a* is inclined, the amount of air which blows the injected fuel at the free end of the pipe member is more than that in the embodiment illustrated in FIG. 1. Therefore, the fuel turns into smaller particles.

In the embodiment illustrated in FIGS. 4 and 5, because the free end 24*b* of the pipe member 23*b* has a flat shaped portion, the fuel injected through the pipe member 23*b* tends to transversely spread, so that the fine fuel particles uniformly collide with the throttle valve 4.

In the embodiment illustrated in FIG. 6, because the free end 24*c* of the pipe member 23*c* is trumpet shaped, a lot of air blows the injected fuel at the free end portion 23*c*, and the fuel tend to transversely spread.

As mentioned above, the present invention provides an improved variable venturi type carburetor which prevents a torque change because the fine fuel particles continuously and uniformly collide with the throttle valve 4. The output power of the engine is improved and noxious combustible substances, such as HC and CO, are reduced because the fuel is uniformly distributed into the respective combustion cylinders of the engine.

What we claimed is:

1. A variable venturi type carburetor of an internal combustion engine, comprising:

a housing;

a bore extending through said housing and having an inner wall defining an intake passage;

a suction piston movably mounted in said housing and having a head portion projecting into said intake passage, said head portion of the suction piston and said inner wall of the intake passage defining a venturi, said suction piston moving so as to change the cross-sectional area of said venturi in response to a change in the vacuum produced in said intake passage downstream of said venturi at a constant value;

an electronic control fuel injection valve being electronically controlled so as to inject the necessary amount of fuel into said intake passage in response to the engine running conditions, and;

a pipe member being opened at a free end thereof to said intake passage in a position opposite said head portion of the suction piston with regard to said intake passage and connected at the other end thereof to a nozzle end portion of said fuel injection valve so that the fuel injected from the fuel injection valve is supplied through said pipe member into the intake passage.

2. A variable venturi type carburetor as set forth in claim 1, wherein said pipe member is so arranged that the central axis thereof is perpendicular to the air flow passing through the venturi portion and is substantially the same as the central axis of the suction piston.

3. A variable venturi type carburetor as set forth in claim 2, wherein the free end of the pipe member is formed by cutting along an inclined oval cross-section and said pipe member is so arranged that the distance from a pipe cut edge at the downstream side of the venturi to said head portion of the suction piston is smaller than the distance from a pipe cut edge at the upstream side of the venturi to the same head portion.

4. A variable venturi type carburetor as set forth in claim 2, wherein said pipe member is formed at the free end thereof with a flat portion which defines an elongated slit extending in the direction perpendicular to the air flowing in the venturi portion and perpendicular to the direction to which the suction piston moves.

5. A variable venturi type carburetor as set forth in claim 2, wherein said pipe member is formed at the free end thereof with a widened shaped portion as a shape of trumpet.

* * * * *